US006338339B1

(12) United States Patent
Tsutsui et al.

(10) Patent No.: US 6,338,339 B1
(45) Date of Patent: Jan. 15, 2002

(54) PRESSURE RELIEF VALVE FOR AN INHALATOR

(75) Inventors: Tatsuo Tsutsui, Kanagawa; Akira Yanagawa, Yokohama, both of (JP)

(73) Assignees: Unisia Jecs Corporation, Atsugi; Dott Limited Co., Yokohama, both of (JP)

( * ) Notice: Subject to any disclaimer, the term of this patent is extended or adjusted under 35 U.S.C. 154(b) by 0 days.

(21) Appl. No.: 09/403,285

(22) PCT Filed: Mar. 19, 1999

(86) PCT No.: PCT/JP99/01387

§ 371 Date: Oct. 19, 1999

§ 102(e) Date: Oct. 19, 1999

(87) PCT Pub. No.: WO99/48773

PCT Pub. Date: Sep. 30, 1999

(30) Foreign Application Priority Data

Mar. 20, 1998 (JP) ..... 10-71084

(51) Int. Cl.[7] ..... A61M 15/00

(52) U.S. Cl. ..... 128/200.23; 128/205.24; 222/396; 222/402.1

(58) Field of Search ..... 128/200.23, 205.24; 222/396, 397, 402.1, 402.16; 251/323

(56) References Cited

U.S. PATENT DOCUMENTS

| | | | | | |
|---|---|---|---|---|---|
| 2,998,168 | A | * | 8/1961 | Waldherr | 222/394 |
| 3,005,577 | A | | 10/1961 | Webster | 222/397 |
| 3,081,919 | A | * | 3/1963 | Samuel | 222/396 |
| 3,083,882 | A | * | 4/1963 | Schmid et al. | 222/396 |
| 3,283,959 | A | * | 11/1966 | Muller | 222/396 |
| 3,519,172 | A | | 7/1970 | Bruce | 222/396 |
| 3,664,557 | A | | 5/1972 | Bruce | 222/397 |
| 3,666,148 | A | | 5/1972 | Webster | 222/396 |
| 3,866,804 | A | | 2/1975 | Stevens | 222/396 |
| 3,870,203 | A | | 3/1975 | Frankenberg | 222/397 |
| 4,030,644 | A | | 6/1977 | Creighton | 222/396 |
| 4,087,048 | A | | 5/1978 | Smrt | 239/146 |
| 5,183,189 | A | | 2/1993 | Baudin | 222/397 |
| 5,234,015 | A | | 8/1993 | Fumino | 137/68.1 |
| 5,645,192 | A | | 7/1997 | Amidzich | 222/1 |

* cited by examiner

*Primary Examiner*—John G. Weiss
*Assistant Examiner*—Mital Patel
(74) *Attorney, Agent, or Firm*—Foley & Lardner

(57) ABSTRACT

A valve includes a valve case secured to a container that stores a pressurized fluid, and a valve pin moveable relative to the valve case and defining a fluid path in cooperation with the valve case. A seal separates the fluid path into an upstream portion communicating with inside of the container and a downstream portion communicating with outside of the container. The valve pin has a main passage always communicating with outside of the container, and a bypass passage. A valve pin adjuster, responsive to change in pressure acting on the valve pin within the container, shifts the valve pin between a first position where fluid communication between the main passage and the upstream portion of the fluid path is blocked to prevent the pressurized fluid from being discharged from the container, and a second position where fluid communication between the upstream and downstream portions of the fluid path is established through the bypass passage to allow the flow of the pressurized fluid from the container.

54 Claims, 6 Drawing Sheets

PRESSURE RELIEF VALVE FOR AN INHALATOR

TECHNICAL FIELD

The present invention relates to a valve for use in an inhalator for aerosolizing a fluid stored in a container by using high pressure gas, for example, liquefied carbon dioxide ($CO_2$) gas, as propellants, and more particularly to an improved valve adapted for restraining excessive increase in pressure within the container.

BACKGROUND ART

There is known apparatus adapted for aerosolizing a fluid such as medicine, that is stored in a container along with high pressure gas as propellant, through a valve fixed to an inlet of the container. The apparatus of this type has conventionally utilized a specific fluorocarbon (flon) as propellant. At present, the apparatus tends to use hydrofluorocarbon HFC134a as an alternative of the specific flon with increasing concern about environmental protection. However, HFC134a influences not ozonosphere but global warming not less than one thousand times the degree caused by $CO_2$. Thus, if HFC134a is used with great frequency, it seems that serious environmental problem occurs. Accordingly, use of $CO_2$ gas or inert gases, for instance, nitrogen, helium, neon, krypton, xenon and radon, acting as aerosol propellant, is at present proposed.

In the case of using such gases as propellant, it is required to liquefy or compress the gases for reducing a size of container as well as the flon conventionally used. The liquefied gases have a high vapor pressure. For example, liquefied $CO_2$ gas has vapor pressure of 60 kgf/cm$^2$ at 20° C. It is also desirable that inert gases are liquefied or compressed under pressure of not less than 50kgf/cm$^2$ in order to increase volumetric efficiency thereof. Japanese Patent Application First Publication No. 7-241498 discloses an aerosol using such liquefied gas.

The liquefied gas as propellant to be filled in the container has high vapor pressure as described above. The vapor pressure within the container tends to rapidly increase in response to even slight temperature rise of the ambient atmosphere. Therefore, such the aerosol must be handled with considerable care.

The above-described conventional art discloses the aerosol including a gas cartridge, a sealing plate fixed to an opening of the gas cartridge, and a gas-emitting valve mounted to the opening of the gas cartridge. Upon using the aerosol, the sealing plate is pierced by a needle connected with the valve to permit liquefied gas to be discharged from the gas cartridge through the sealing plate pierced. The sealing plate is adapted to be locally ruptured and escape the liquefied gas from the gas cartridge in response to increase in vapor pressure therewithin during storage before use. The conventional art has effects of avoiding contingencies that may be caused due to the increasing vapor pressure within the gas cartridge, whereby the gas cartridge can be safely stored. However, if the gas cartridge is used once and then vapor pressure therewithin excessively increases, the conventional art can no longer teach any effective measure.

It is an object of the present invention to provide a valve for use in an inhalator that is capable of relieving pressure within a container of the inhalator in response to a large increase in vapor pressure therewithin.

It is a further object of the present invention to provide an inhalator for aerosolizing fluid stored in a container with pressurized gas, that is capable of always restraining excessive increase in vapor pressure within the container.

DISCLOSURE OF INVENTION

According to one aspect of the present invention, there is provided a valve for an inhalator including a container having a pressurized fluid, comprising:

a valve case secured to the container;

a valve pin moveable relative to said valve case, said valve pin cooperating with said valve case to define a fluid path for discharging the pressurized fluid from the container, said valve pin having a portion extending through said valve case into the container to be exposed to the pressurized fluid;

a seal arranged within said valve case so as to separate said fluid path into an upstream portion communicating with inside of the container and a downstream portion communicating with outside of the container; and said valve pin defining a main passage always communicating with outside of the container and a bypass passage, said valve pin having a first position where fluid communication between said main passage and said upstream portion of said fluid path is blocked to prevent the pressurized fluid from being discharged from the container and a second position where fluid communication between said upstream portion and said downstream portion of said fluid path is established through said bypass passage to permit the pressurized fluid to flow from the container;

a valve pin adjuster shifting said valve pin between said first position and said second position in response to change in pressure acting on said valve pin, said valve pin adjuster being mounted to said valve pin.

According to a further aspect of the present invention, there is provided an inhalator, comprising:

a container having an open end and a pressurized fluid;

a valve case secured to the open end of said container;

a valve pin moveable relative to said valve case, said valve pin cooperating with said valve case to define a fluid path through which said pressurized fluid is discharged from said container, said valve pin having a portion extending through said valve case into said container to be exposed to said pressurized fluid;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said main passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin.

According to a still further aspect of the present invention, there is provided a valve for an inhalator including a container, comprising:

a pressurized fluid stored in the container;

a valve case secured to the container;

a valve pin moveable relative to said valve case, said valve pin cooperating with said valve case to define a fluid path through which said pressurized fluid is discharged from the container, said valve pin having a portion extending through said valve case into the container to be exposed to said pressurized fluid;

a seal arranged within said valve case so as to separate said fluid path into an upstream portion communicating with inside of the container and a downstream portion communicating with outside of the container; and said valve pin defining a main passage always communicating with outside of the container and a bypass passage, said valve pin having a first position where fluid communication between said main passage and said upstream portion of said fluid path is blocked to prevent said pressurized fluid from being discharged from the container and a second position where fluid communication between said upstream portion and said downstream portion of said fluid path is established through said bypass passage to permit said pressurized fluid to flow from the container;

a valve pin adjuster shifting said valve pin between said first position and said second position in response to change in pressure acting on said valve pin, said valve pin adjuster being mounted to said valve pin.

According to a further aspect of the present invention, there is provided an inhalator, comprising:

a container having an open end;

a pressurized fluid stored in said container;

a valve case secured to the open end of said container;

a valve pin moveable relative to said valve case, said valve pin cooperating with said valve case to define a fluid path through which said pressurized fluid is discharged from said container;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said main passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin.

BEST MODE FOR CARRYING OUT THE INVENTION

Figure 1:
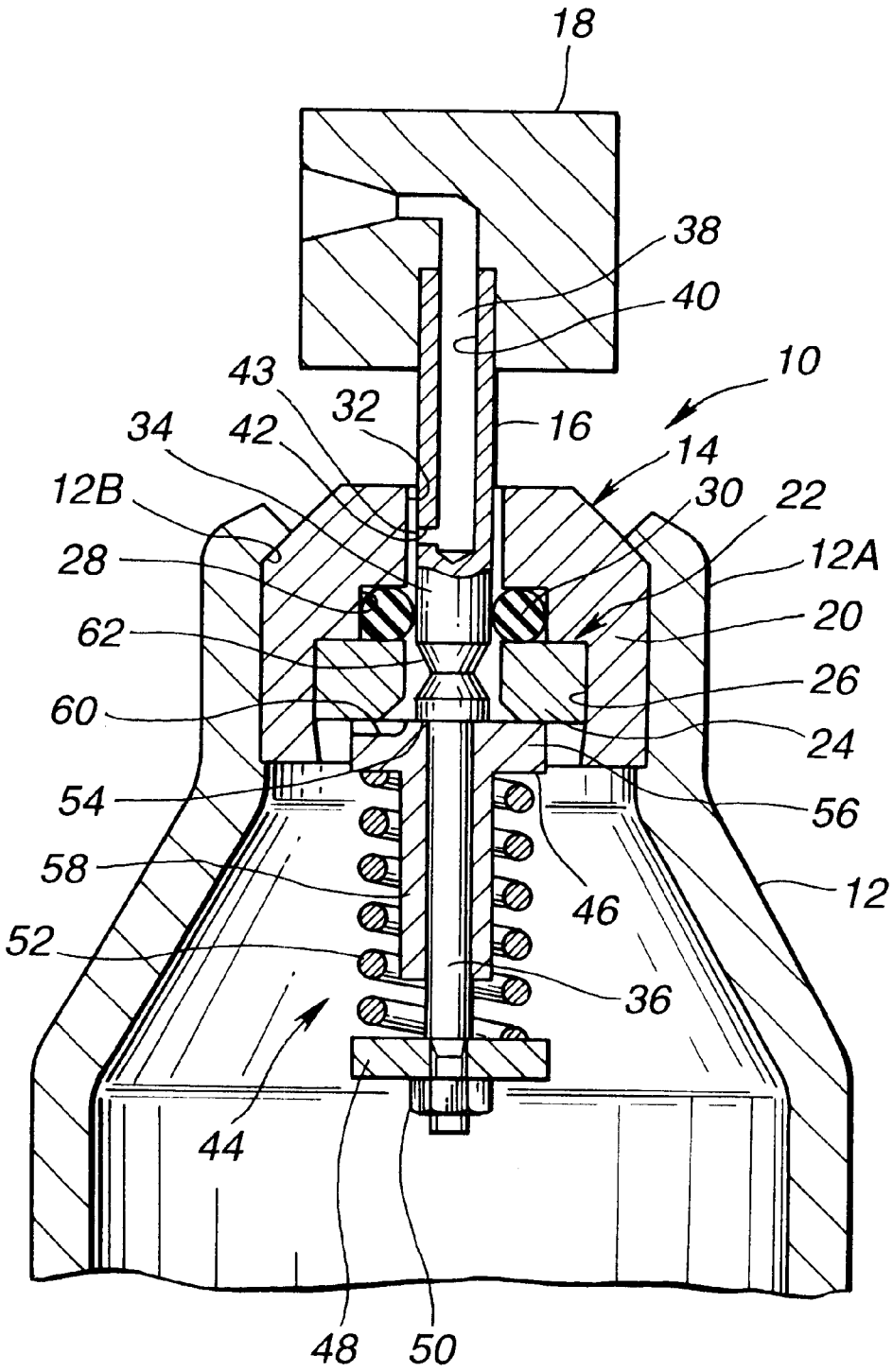
FIG. 1 is a section of a valve of a first embodiment according to the present invention.
Figure 2:
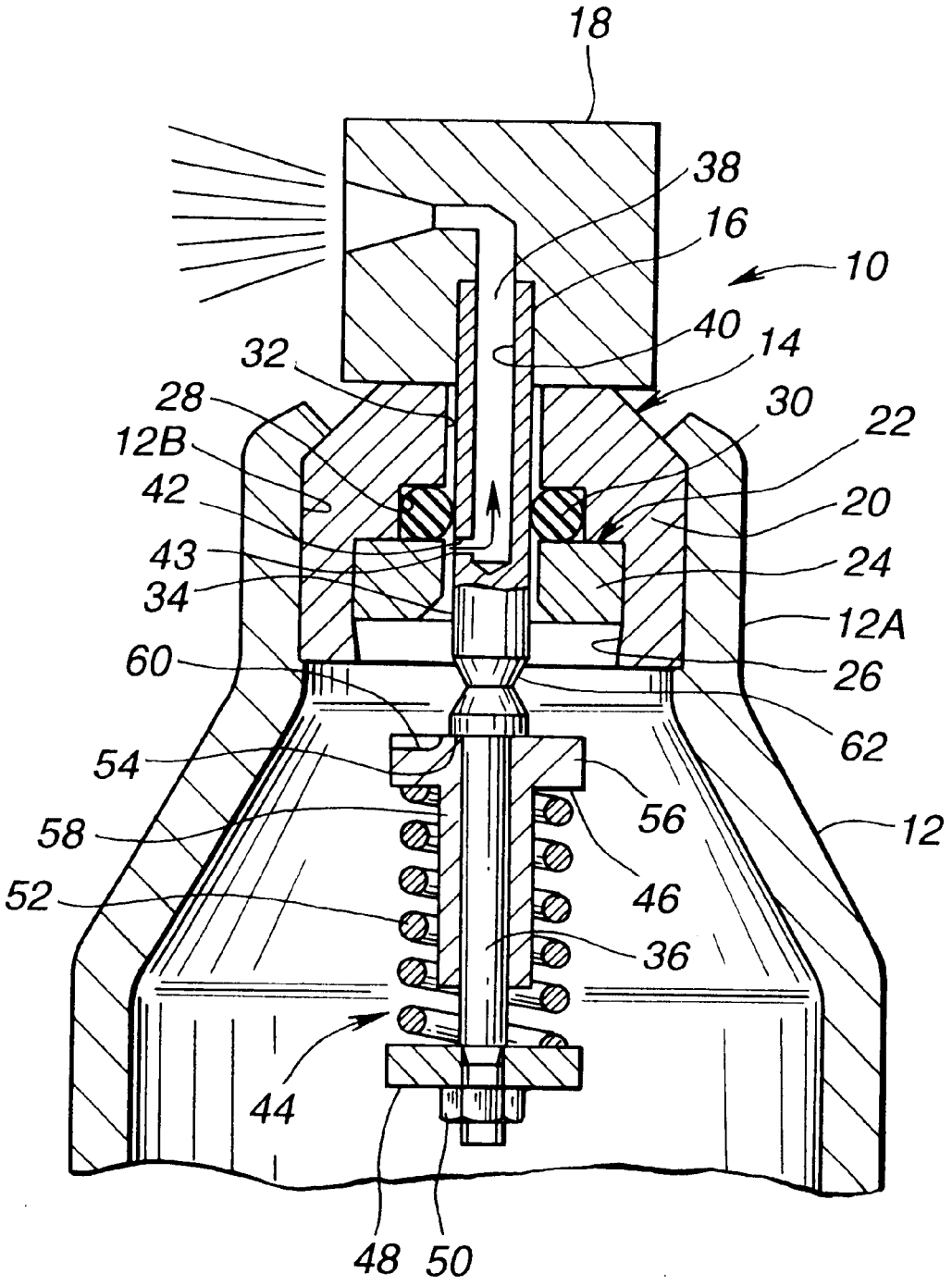
FIG. 2 is a view similar to FIG. 1, but showing the valve placed in a position different from FIG. 1.
Figure 3:
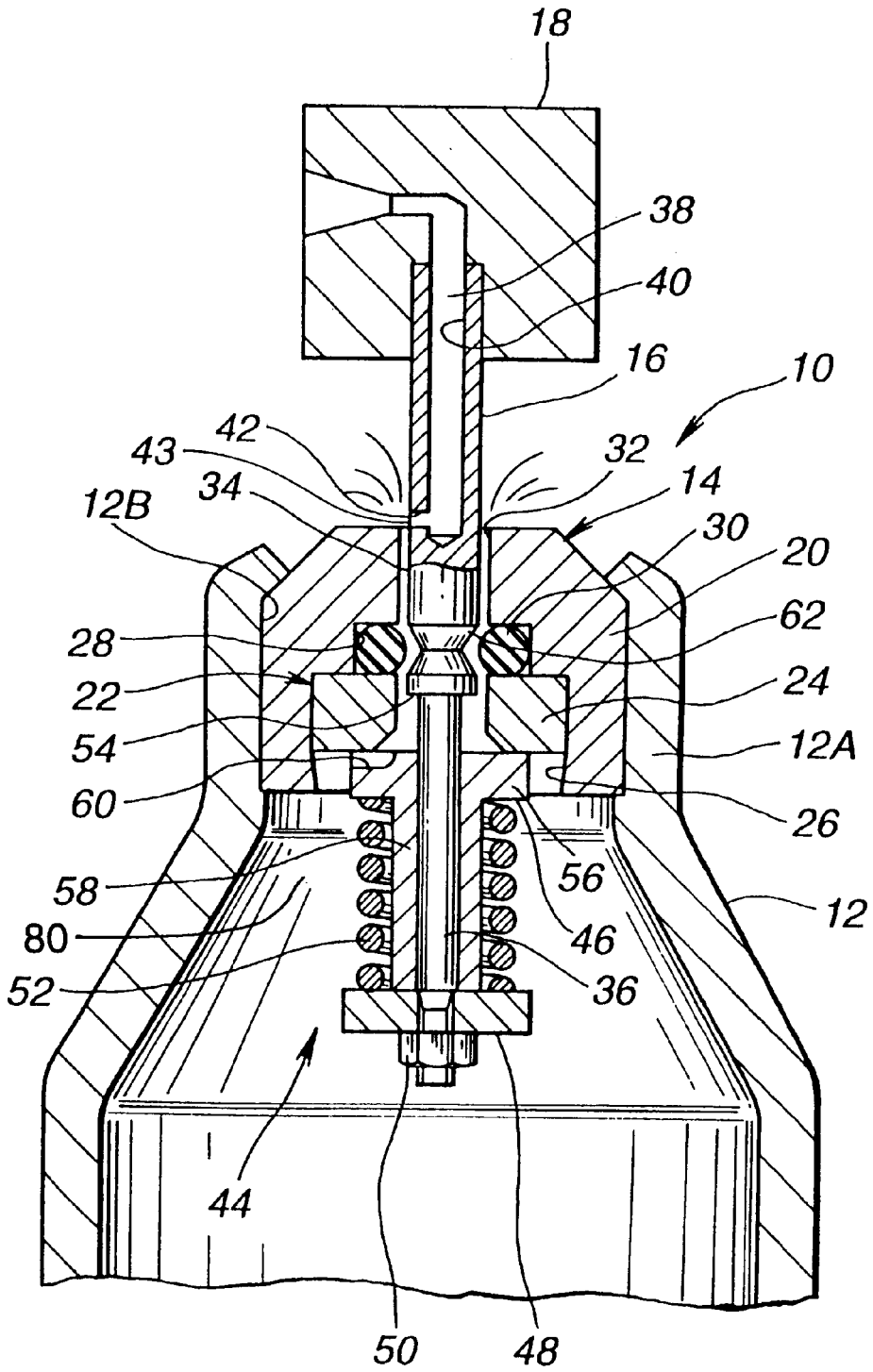
FIG. 3 is a view similar to FIGS. 1 and 2, but showing the valve placed in a position different from FIGS. 1 and 2.

Referring now to FIGS. 1 to 3, a valve 10 and an inhalator with the valve 10, according to the present invention, are explained.

As illustrated in FIG. 1, the inhalator includes a container 12 having an open end 12A that defines an aperture 12B. The container 12 receives a fluid such as medicine, and pressurized gas acting as propellant, for instance, liquefied carbon dioxide ($CO_2$) gas or the like. The valve 10 is hermetically mounted to the open end 12A of the container 12. The valve 10 includes a valve case 14 secured to the open end 12A of the container 12 and a valve pin 16 axially moveable relative to the valve case 14. The valve case 14 has a central through bore 32 through which the vale pin 16 moves between first, second and third positions described in detail later. The valve case 14 and the valve pin 16 cooperate to define therebetween a fluid path for discharging the fluid entrained on the pressurized gas (the mixture is hereinafter referred to as merely "pressurized fluid") from the container 12. The fluid path allows fluid communication between inside and outside of the container 12. The pressurized fluid is discharged from inside of the container 12 through the fluid path. The valve pin 16 extends through the valve case 14 and has one axial end, a lower end as viewed in FIG. 1, projecting inside the case 14 and an opposite axial end, an upper end as viewed in FIG. 1, projecting outside the valve case 14. A nozzle button 18 acting as a nozzle and a pushbutton is mounted to the upper end of the valve pin 16. The nozzle button 18 has a passage feeding the pressurized fluid from the container 12 through the valve pin 16 as explained later, and an aerosolizing outlet communicating with the passage to aerosolize the pressurized fluid therefrom.

Specifically, the valve case 14 is fitted into the aperture 12B and caulked at the open end 12A. The fluid path is disposed between an inner peripheral surface of the valve case 14 that defines the through bore 32 and an outer circumferential surface of the valve pin 16 that is opposed to the inner peripheral surface of the valve case 14. The valve case 14 includes a case body 20 formed with a stepped bore 22 partly forming the through bore 32 and a plug 24 disposed within the stepped bore 22. The stepped bore 22 includes a larger-diameter portion 26 exposed to the inside of the container 12, and a smaller-diameter portion 28 connected with the larger-diameter portion 26. The plug 24 is fitly fixed to the larger-diameter portion 26 of the stepped bore 22 and formed with an opening forming a part of the through bore 32. The smaller-diameter portion 28 of the stepped bore 22 cooperates with the plug 24 to define an annular groove for retaining a seal 30 of a ring shape.

The seal 30 is fitted to the annular groove and partly projects into the through bore 32 to come into contact with the outer circumferential surface of the valve pin 16. The seal 30 separates the fluid path into an upstream portion communicating with inside of the container 12 and a downstream portion communicating with outside of the container 12. The seal 30 blocks the fluid path to prevent the pressurized fluid from being discharged from inside of the container 12 to outside thereof. The seal 30 is made of a suitable elastic material.

As illustrated in FIG. 1, the valve pin 16 includes a greater-diameter pin portion 34 partly projecting to the outside of the container 12 and a smaller-diameter pin portion 36 partly projecting into the container 12. The smaller-diameter pin portion 36 has a predetermined length and is exposed to the pressurized fluid.

The valve pin 16 defines a main passage 38 for feeding the pressurized fluid to outside of the container 12. The main passage 38 is formed in the greater-diameter pin portion 34 and always communicates with outside of the container 12 via the passage of the nozzle button 18. The main passage 38 includes an axially extending hole 40 and a radially outwardly extending orifice 42 connected with a bottom of the axially extending hole 40. The main passage 38 has an outlet open to the upper end face of the valve pin 16 and an inlet 43 open to the outer circumferential surface of the valve pin 16. Namely, the axially extending hole 40 is open to the upper end face of the valve pin 16 and the orifice 42 is open to the outer circumferential surface of the valve pin 16. The axially extending hole 40 has a relatively large diameter and the orifice 42 has a predetermined diameter smaller than the diameter of the hole 40. The orifice 42 determines an amount of flow of the pressurized fluid to be aerosolized per unit time. Accordingly, a diameter of the orifice 42 can be suitably determined depending on a required amount of the flow of the pressurized fluid to be aerosolized per unit time. The inlet 43 defined by the orifice 42 is arranged at a predetermined portion on the outer circumferential surface of the valve pin 16 which is spaced at a predetermined distance from the outlet in the axial direction of the valve pin 16. More specifically, the inlet 43 is located above the seal 30 and exposed to the downstream portion of the fluid path when the valve pin 16 is placed in the first position shown in FIG. 1, while the inlet 43 is located below the seal 30 and exposed to the upstream portion of the fluid path when the valve pin 16 is placed in the third position shown in FIG. 2.

The valve pin has a bypass passage 62 formed on the outer circumferential surface of the greater-diameter pin portion 34 of the valve pin 16. The bypass passage 62 is in the form of an annular groove having a V-shaped section shown in FIG. 1. The bypass passage 62 has a width farther extending in the axial direction of the valve pin 16 than that of the seal 30. The bypass passage 62 is arranged in a predetermined portion which is exposed to the upstream portion of the fluid path when the valve pin 16 is in the first position shown in FIG. 1 and which is substantially opposed to the seal 30 when the valve pin 16 is in the second position shown in FIG. 3. Thus, when the valve pin 16 is in the second position, the bypass passage 62 allows fluid communication between the upstream and downstream portions of the fluid path.

The valve pin 16 has the first position shown in FIG. 1, in which fluid communication between the main passage 38 and the upstream portion of the fluid path is blocked to prevent the pressurized fluid from being discharged from the container 12. In the first position, fluid communication between the bypass passage 62 and the downstream portion of the fluid path is also blocked. The fluid communication between the inside and outside of the container 12 is restrained, so that the pressurized fluid is prohibited from being discharged from the container 12 via both of the main passage 38 and the bypass passage 62.

Further, the valve pin 16 has the second position shown in FIG. 3, in which the fluid communication between the upstream and downstream portions of the fluid path is established through the bypass passage 62 to permit the pressurized fluid to be discharged from the container 12. On the other hand, in the second position, the inlet 43 of the main passage 38 is exposed to outside of the valve case 14 whereby the fluid communication between the main passage 38 and the fluid path is interrupted. The fluid communication between the inside and outside of the container 12 via the bypass passage 62 is allowed but the fluid communication therebetween via the main passage 38 is prevented. Therefore, the pressurized fluid within the container 12 is permitted to flow to outside of the container 12.

The valve pin 16 also has a third position shown in FIG. 2. The valve pin 16 is moved to the third position by depressing the nozzle button 18 toward the container 12. In the third position, the fluid communication between the main passage 38 and the upstream portion of the fluid path is established. The fluid communication between the inside and outside of the container 12 is allowed via the main passage 38 to permit the pressurized fluid to be discharged from the container 12. In this position, the bypass passage 62 is located fully inside the container 12 to be inactive in fluid communication between inside and outside of the container 12.

The valve pin 16 is shifted by a valve pin adjuster 44 between the first and second positions in response to change in vapor pressure within the container 12 that acts on the valve pin 16. The valve pin adjuster 44 is slidably mounted to the smaller-diameter pin portion 36 of the valve pin 16. The valve pin adjuster 44 holds the valve pin 16 in the first position when the vapor pressure within the container 12 is less than a predetermined value and in the second position when the vapor pressure therewithin is not less than the predetermined value.

The valve pin adjuster 44 includes a stop 46 mounted to the valve pin 16 and a resilient member 52 acting between the valve case 14 and the lower end of the valve pin 16. The stop 46 is fitted onto the smaller-diameter pin portion 36 of the valve pin 16 and slidable thereon in the axial direction. The resilient member 52 is in the form of a coiled spring in this embodiment. The valve pin adjuster 44 also includes a retainer 48 that supports one end of the resilient member 52 on an upper end face thereof. The retainer 48 is fixed to the lower end of the valve pin 16 by a fastening nut 50.

The stop 46 includes a flange 56 supporting an opposite end of the resilient member 52 and a hollow cylindrical guide 58 that is connected with the flange 56 and guides the resilient member 52 along an outer circumferential surface thereof. The guide 58 and the resilient member 52 are disposed within the container 12 and opposed to each other on their circumferential surfaces. The stop 46 defines a communicating passage 60 always fluidly connecting the upstream portion of the fluid path with inside of the container 12. The communicating passage 60 is formed on an upper surface of the flange 56.

The stop 46 is forced by a setting load of the resilient member 52 to be in contact with a shoulder portion 54 of the valve pin 16 that is disposed between the greater-diameter pin portion 34 and the smaller-diameter pin portion 36. Specifically, as shown in FIG. 1, an inner circumferential portion of the upper surface of the flange 56 of the stop 46 is in contact with the shoulder portion 54. The stop 46 is thus prevented from upwardly moving relative to the valve pin 16 by the contact of the flange 56 with the shoulder portion 54.

The stop 46 is forced by the vapor pressure within the container 12 to be in contact with a lower face of the valve case 14. Namely, an outer peripheral portion of the upper surface of the flange 56 of the stop 46 is in contact with an inner peripheral portion of a lower face of the plug 24 that surrounds the opening thereof. The setting load of the resilient member 52 is set at a predetermined value greater than the vapor pressure acting on the valve pin 16 under such a normal condition that the vapor pressure within the container 12 is within a constant pressure range. Accordingly, when the vapor pressure within the container 12 is within the constant pressure range, the flange 56 of the stop 46 is urged against the lower face of the valve case 14 while it is kept in contact with the shoulder 54 of the valve pin 16. In such a case, the valve pin 16 is held in the first position as shown in FIG. 1.

The retainer 48 has a stop-limiting portion on the upper end face that is in contact with the stop 46 to limit the downward movement of the stop 46 relative to the valve pin 16 when the valve pin 16 is placed in the second position shown in FIG. 3. Specifically, when the vapor pressure within the container 12 becomes not less than the predetermined value, the resilient member 52 is brought into a compressed state by the vapor pressure acting on the lower end of the valve pin 16 and a lower end face of retainer 48. The valve pin 16 with the retainer 48 is moved upwardly against the biasing force of the resilient member 52 until the upper end face of the retainer 48 comes into contact with a lower end of the cylindrical guide 58 of the stop 46. The upward movement of the valve pin 16 is thus restrained in the second position. During the upward movement of the valve pin 1 6, the upper surface of the flange 56 of the step 46 is kept in contact with the lower face of the valve case 14.

An operation of the valve 10 of the above-described first embodiment is explained hereinafter.

When the nozzle button 18 is in a non-depressed position shown in FIG. 1, under condition that the vapor pressure within the container 12 is within the predetermined range, the valve pin 16 is held by the valve pin adjuster 44 in a normal position, i.e., the first position shown in FIG. 1. In this case, the inlet 43 of the main passage 38, i.e., the opening of the orifice 42, is located downstream of the seal 30 contacted with the outer circumferential surface of the valve pin 16. The main passage 38 is prevented from fluidly communicating with the upstream portion of the fluid path and then inside of the container 12. On the other hand, the bypass passage 62 is located upstream of the seal 30 and inactive in fluid communication with the upstream and downstream portions of the fluid path. As a result, the pressurized fluid within the container 12 is prevented from flowing therefrom through the main passage 38 and the bypass passage 62.

When the nozzle button 18 is depressed, the valve pin 16 is displaced into the third position shown in FIG. 2. At this time, the inlet 43 of the main passage 38 is located upstream of the seal 30 contacted with the outer circumferential surface of the valve pin 16. The main passage 38 is in fluid communication with the upstream portion of the fluid path and the inside of the container 12. Thus, the pressurized fluid within the container 12 is discharged from the container 12 through the main passage 38 and the aerosolizing outlet of the nozzle button 18.

When the vapor pressure within the container 12 becomes not less than the predetermined value due to increase in atmospheric temperature under condition that the nozzle button 18 is in the non-depressed position, the pressure force acting on the valve pin 16 becomes greater than the biasing force of the resilient member 52 to thereby deform the resilient member 52 to the compressed state. When the resilient member 52 is compressedly deformed by a predetermined degree, the retainer 48 comes into contact with the cylindrical guide 58 of the stop 46 and the valve pin 16 is placed in the second position shown in FIG. 3. In this condition, the bypass passage 62 of the valve pin 16 is opposed to the seal 30 and active to establish fluid communication between the upstream 80 and downstream 81 portions of the fluid path. The inside of the container 12 is in fluid communication with the outside thereof via the bypass passage 62, whereby the vapor pressure exceeding the predetermined value is relieved from the container 12. Thus, the vapor pressure within the container 12 is reduced.

When the vapor pressure within the container 12 decreases to a value less than the predetermined value, the valve pin 16 is moved back to the first position shown in FIG. 1, by the restoring force of the resilient member 52. The fluid communication between the upstream and downstream portions of the fluid path is blocked again by the hermetic contact of the seal 30 with the outer circumferential surface of the valve pin 16. The relief of the vapor pressure within the container 12 is thus prohibited.

As explained above, the valve 10 and the inhalator with the valve 10, according to the present invention, have a simple structure and assures avoiding contingencies that may be caused due to the excessive increase in vapor pressure within the container 12. Namely, the valve pin adjuster 44 allows the fluid communication between the inside and outside of the container 12 through the bypass passage 62 of the valve pin 16 in response to increase in vapor pressure within the container 12 to the predetermined value.

Further, if the vapor pressure within the container 12 is relieved therefrom once, the valve pin 16 can be returned to the normal first position by the restoring force of the resilient member 52. Accordingly, even if the vapor pressure within the container 12 increases to not less than the predetermined value again after the return of the valve pin 16 to the normal first position, the valve pin 16 can be displaced into the second position in response to the increase in vapor pressure within the container 12. Therefore, the vapor pressure can be relieved from the container 12 via the bypass passage 62 so that the vapor pressure within the container 12 can decrease to below the predetermined value. Thus, the inhalator can always restrain excessive increase in vapor pressure within the container 12.

Furthermore, with the arrangement of the communicating passage 60 on the flange 56 of the stop 46, the inside of the container 12 always communicates with the upstream portion of the fluid path. The fluid communication between them is advantageous in securing a relief passage for relieving vapor pressure within the container 12 without being interrupted by the resilient member 52 upon the vapor pressure within the container 12 increasing.

Referring to FIGS. 4 to 9, valves 100, 200, 300 and 400 of second, third, fourth and fifth embodiments according to the present invention are explained hereinafter, which differ in arrangement of the bypass passage of the valve pin from the valve 10 of the above-described first embodiment. Like reference numerals denote like parts and therefore detailed explanations therefor are omitted.

Figure 4:
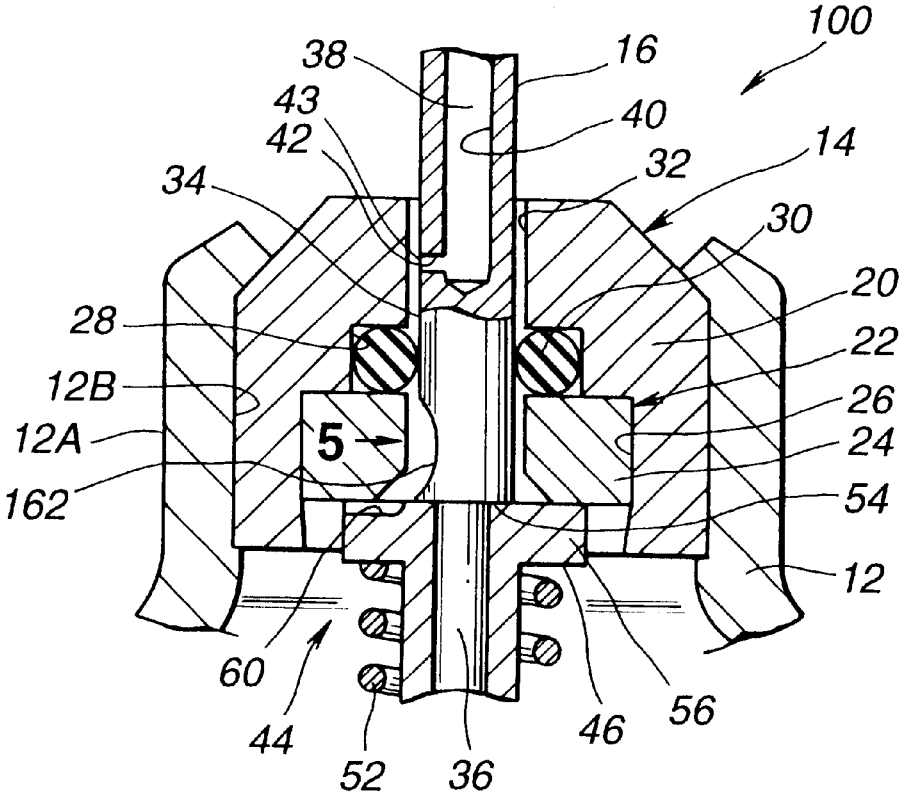
FIG. 4 is a section of a valve of a second embodiment according to the present invention.
Figure 5:
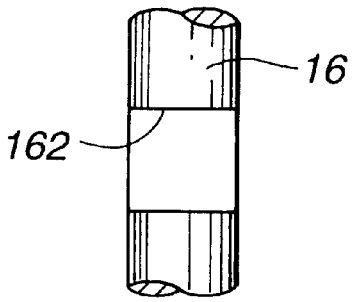
FIG. 5 is a view of a valve pin of the valve shown in FIG. 4, as viewed in a direction indicated by the arrow 5 of FIG. 4.

FIGS. 4 and 5 show the valve 100 of the second embodiment, in which the bypass passage 162 is in the form of a round cutout formed on a predetermined portion on the outer circumferential surface of the valve pin 16. The bypass passage 162 has an arcuate section taken along the axial direction of the valve pin 16 as shown in FIG. 4. The bypass passage 162 is partly defined by opposed peripheral edges shown in FIG. 5, that lie in parallel planes perpendicular to the axial direction of the valve pin 16.

Figure 6:
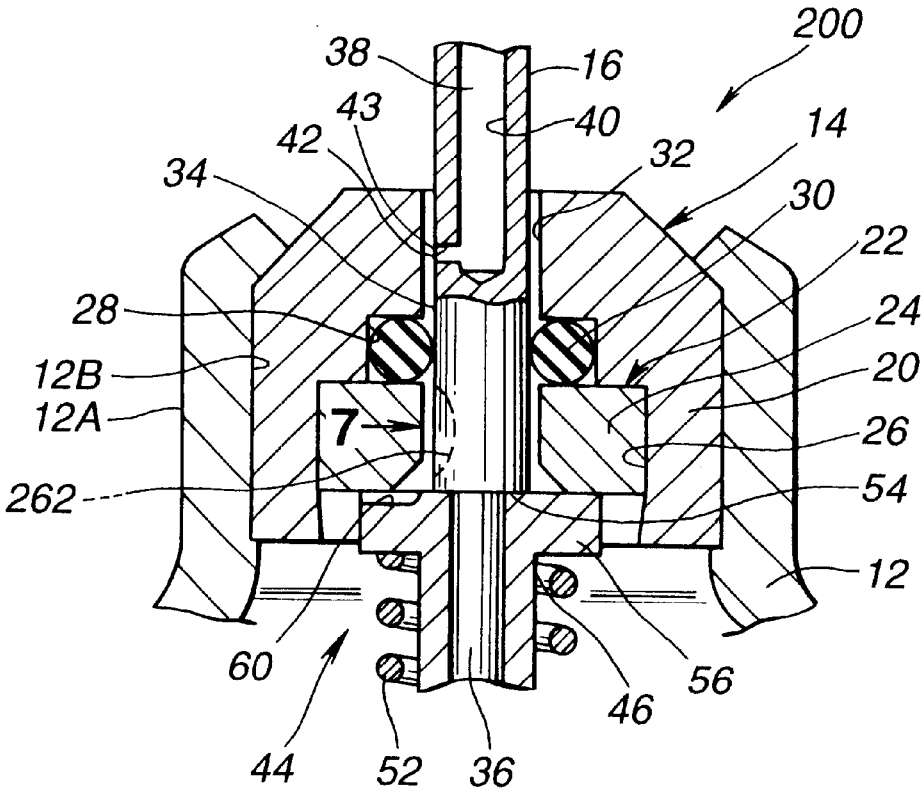
FIG. 6 is a section of a valve of a third embodiment according to the present invention.
Figure 7:
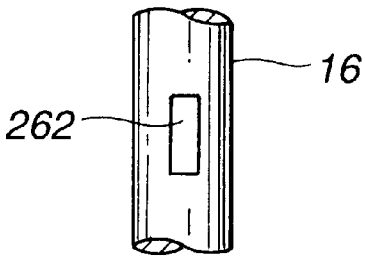
FIG. 7 is a view of a valve pin of the valve shown in FIG. 6, as viewed in a direction indicated by the arrow 7 of FIG. 6.

FIGS. 6 and 7 show the valve 200 of the third embodiment. As illustrated in FIG. 6, the bypass passage 262 is in the form of substantially a half-round key way-shaped cutout, which is formed on a predetermined portion on the outer circumferential surface of the valve pin 16. The bypass passage 262 has a rectangular shape in a front view as shown in FIG. 7. The bypass passage 262 is defined by opposed peripheral edges lying in parallel planes perpendicular to the axial direction of the valve pin 16.

In both of the second and third embodiments, the cutouts as the bypass passages 162 and 262 are arranged on the predetermined portions on the outer circumferential surface of the valve pin 16, respectively. With this arrangement, the formation of the bypass passages 162 and 262 can be facilitated as compared with the bypass passage 62 of the first embodiment that is formed of the annular groove and therefore the manufacturing cost can be reduced.

Figure 8:
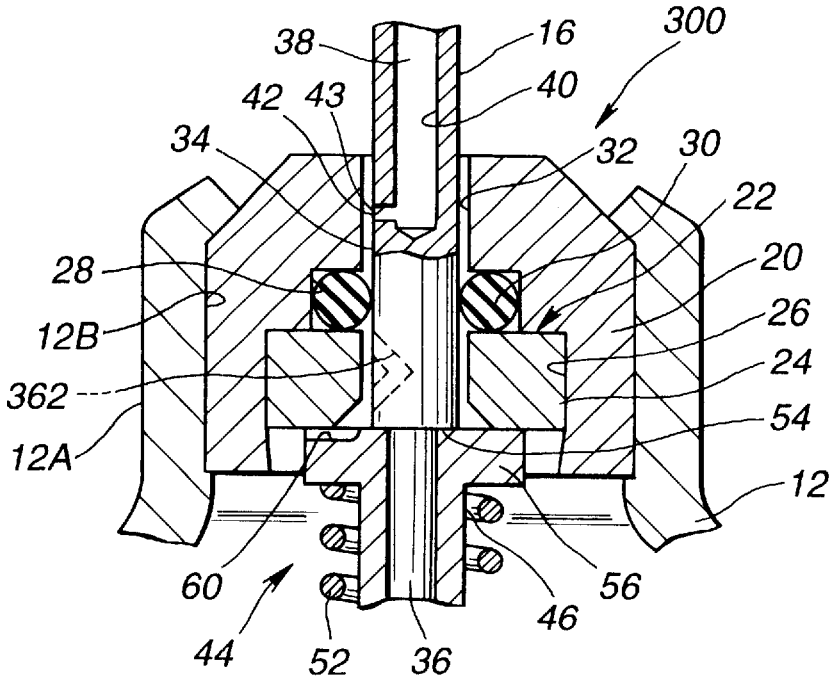
FIG. 8 is a section of a valve of a fourth embodiment according to the present invention.

FIG. 8 shows the valve 300 of the fourth embodiment, in which the bypass passage 362 is in the form of a through hole having a generally V shape as indicated by a phantom line. The bypass passage 362 has openings on the outer circumferential surface of the valve pin 16 that are spaced from each other in the axial direction of the valve pin 16.

Figure 9:
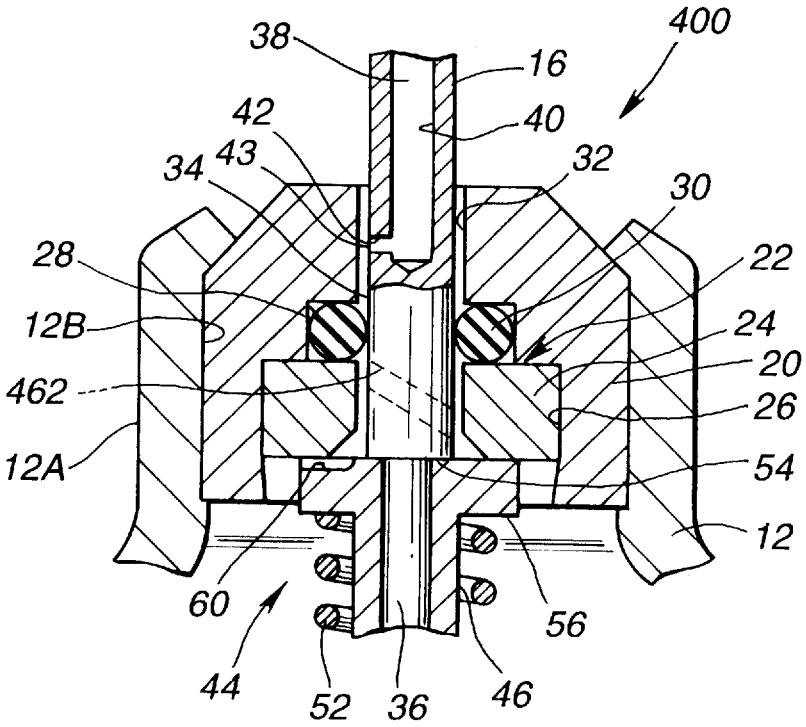
FIG. 9 is a section of a valve of a fifth embodiment according to the present invention.

FIG. 9 shows the valve 400 of the fifth embodiment, in which the bypass passage 462 is in the form of a straight and inclined through hole as indicated by a phantom line. The bypass passage 462 extends inclining relative to the axial direction of the valve pin 16 and has openings on the outer circumferential surface of the valve pin 16 that are spaced from each other in the axial direction of the valve pin 16.

In the fourth and fifth embodiments, the openings of the bypass passages 362 and 462 that are open to the outer circumferential surface of the valve pin 16 have smaller areas than the opening of the bypass passage 62 formed into the annular groove in the first embodiment. Therefore, upon displacement of the valve pin 16, butting of the seal 30 against the periphery of the openings of the bypass passages 362 and 462 can be alleviated. As a result, the seal 30 can be prevented from being heavily deteriorated by duration of use, so that the durability of the seal 30 can be improved.

INDUSTRIAL APPLICABILITY

As described above, the valve of the present invention is useful in relieving vapor pressure from a container storing pressurized fluid, in response to the vapor pressure within the container becoming not less than the predetermined value. The valve is applicable to apparatus, such as inhalator, sprayer and the like, including a container storing fluid along with pressurized gas as propellant. Further, the inhalator of the present invention is useful in always avoiding excessive increase in vapor pressure within a container that stores fluid along with pressurized gas. The inhalator of the present invention is generally applicable to inhalators using pressurized gas as aerosol propellant.

What is claimed is:

1. An inhalator, comprising:

a container having an open end and a pressurized fluid;

a valve case secured to the open end of said container;

a valve pin moveable relative to said valve case, said valve pin cooperating with said valve case to define a fluid path through which said pressurized fluid is discharged from said container, said valve pin having a portion extending through said valve case into said container to be exposed to said pressurized fluid;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin, wherein said valve pin adjuster includes a resilient member acting between said valve case and one axial end of said valve pin that is disposed within said container, wherein said valve pin adjuster includes a retainer supporting said resilient member, said retainer being mounted to one axial end of said valve pin that projects from said valve case to inside of said container.

2. An inhalator as claimed in claim 1, wherein said retainer has a limiting portion contacted with said stop to limit an opposite axial movement of said stop when said valve pin is held in said second position.

3. An inhalator as claimed in claim 1, wherein said valve pin adjuster holds said valve pin in said first position when the pressure within said container is less than a predetermined value and in said second position when the pressure within said container is not less than said predetermined value.

4. An inhalator as claimed in claim 1, wherein said valve pin adjuster includes a stop moveable relative to said valve pin in the axial direction of said valve pin, said stop being mounted to said portion of said valve pin and biased by said resilient member toward said valve case, wherein said stop defines a communicating passage fluidly connecting said upstream portion of said fluid path with inside of said container.

5. An inhalator as claimed in claim 4, wherein said stop has a flange that supports said resilient member and is contacted with said valve case.

6. An inhalator as claimed in claim 4, wherein said communicating passage is formed on the flange of said stop.

7. An inhalator as claimed in claim 1, wherein said valve pin adjuster includes a stop moveable relative to said valve pin in the axial direction of said valve pin, said stop being mounted to said portion of said valve pin and biased by said resilient member toward said valve case, wherein said valve pin has a shoulder portion, said shoulder portion being in contact with said stop to limit one axial movement of said stop when said valve pin is held in said first position and looses the contact therewith when said valve pin is held in said second position.

8. An inhalator as claimed in claim 1, wherein said bypass passage is arranged at a predetermined portion of said valve pin which is exposed to said upstream portion of said fluid path when said valve pin is held in said first position and which is substantially opposed to said seal when said valve pin is held in said second position.

9. An inhalator as claimed in claim 1, wherein said valve pin has a third position where the fluid communication between said main passage and said upstream portion of said fluid path is established to permit said pressurized fluid to be discharged from said container.

10. An inhalator as claimed in claim 9, wherein said main passage has an inlet open to a predetermined portion on an outer periphery of said valve pin which is axially spaced at a predetermined distance from an axial end of said valve pin that is disposed outside of said container.

11. An inhalator, comprising:

a container having an open end and a pressurized fluid;

a valve case secured to the open end of said container;

a valve pin moveable relative to said valve case, said valve pin cooperating with said valve case to define a fluid path through which said pressurized fluid is discharged from said container, said valve pin having a portion extending through said valve case into said container to be exposed to said pressurized fluid;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin, wherein said bypass passage includes a groove open to an outer periphery of said valve pin.

12. An inhalator as claimed in claim 11, wherein said bypass passage includes a through hole having openings spaced from each other in the axial direction of said valve pin.

13. An inhalator as claimed in claim 11, wherein said valve pin adjuster holds said valve pin in said first position when the pressure within said container is less than a predetermined value and in said second position when the pressure within said container is not less than said predetermined value.

14. An inhalator as claimed in claim 11, wherein said valve pin adjuster includes a resilient member acting between said valve case and one axial end of said valve pin that is disposed within said container.

15. An inhalator as claimed in claim 14, wherein said valve pin adjuster includes a stop moveable relative to said valve pin in the axial direction of said valve pin, said stop being mounted to said portion of said valve pin and biased by said resilient member toward said valve case.

16. An inhalator as claimed in claims 15, wherein said stop defines a communicating passage fluidly connecting said upstream portion of said fluid path with inside of said container.

17. An inhalator as claimed in claim 16, wherein said stop has a flange that supports said resilient member and is contacted with said valve case.

18. An inhalator as claimed in claim 16, wherein said communicating passage is formed on a flange of said stop.

19. An inhalator as claimed in claim 15, wherein said valve pin has a shoulder portion, said shoulder portion being in contact with said stop to limit one axial movement of said stop when said valve pin is held in said first position and looses the contact therewith when said valve pin is held in said second position.

20. An inhalator as claimed in claim 11, wherein said valve pin has a third position where the fluid communication between said main passage and said upstream portion of said fluid path is established to permit said pressurized fluid to be discharged from said container.

21. An inhalator as claimed in claim 20, wherein said main passage has an inlet open to a predetermined portion on an outer periphery of said valve pin which is axially spaced at a predetermined distance from an axial end of said valve pin that is disposed outside of said container.

22. An inhalator, comprising:

a container having an open end;

a pressurized fluid stored in said container;

a valve case secured to the open end of said container;

a valve pin moveable relative to said valve case, said valve pin cooperating with said valve case to define a fluid path through which said pressurized fluid is discharged from said container;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said main passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin, wherein said valve pin adjuster includes a resilient member acting between said valve case and one axial end of said valve pin that is disposed within said container, wherein said valve pin adjuster includes a stop moveable relative to said valve pin in the axial direction of said valve pin, said stop being mounted to said portion of said valve pin and biased by said resilient member toward said valve case, wherein said valve pin has a shoulder portion, said shoulder portion being in contact with said stop to limit one axial movement of said stop when said valve pin is held in said first position and looses the contact therewith when said valve pin is held in said second position.

23. An inhalator as claimed in claim 3, wherein said valve pin adjuster holds said valve pin in said first position when the pressure within said container is less than a predetermined value and in said second position when the pressure within said container is not less than said predetermined value.

24. An inhalator as claimed in claim 3, wherein said stop defines a communicating passage fluidly connecting said upstream portion of said fluid path with inside of said container.

25. An inhalator as claimed in claim 24, wherein said stop has a flange that supports said resilient member and is contacted with said valve case.

26. An inhalator as claimed in claim 25, wherein said communicating passage is formed on the flange of said stop.

27. An inhalator as claimed in claim 3, wherein said bypass passage is arranged at a predetermined portion of said valve pin which is exposed to said upstream portion of said fluid path when said valve pin is held in said first position and which is substantially opposed to said seal when said valve pin is held in said second position.

28. An inhalator as claimed in claim 3, wherein said valve pin has a third position where the fluid communication between said main passage and said upstream portion of said fluid path is established to permit said pressurized fluid to be discharged from said container.

29. An inhalator as claimed in claim 28, wherein said main passage has an inlet open to a predetermined portion on an outer periphery of said valve pin which is axially spaced at a predetermined distance from an axial end of said valve pin that is disposed outside of said container.

30. An inhalator as claimed in claim 3, wherein said pressurized fluid includes a fluid to be aerosolized and a propellant.

31. An inhalator as claimed in claim 30, wherein said propellant includes a liquefied or compressed carbon dioxide gas.

32. An inhalator, comprising:

a container having an open end;

a pressurized fluid stored in said container;

a valve case secured to the open end of said container;

a valve pin moveable relative to said valve case, said valve pin cooperating with said valve case to define a fluid path through which said pressurized fluid is discharged from said container;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said main passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin, wherein said valve pin adjuster includes a resilient member acting between said valve case and one axial end of said valve pin that is disposed within said container, wherein said valve pin adjuster includes a stop moveable relative to said valve pin in the axial direction of said valve pin, said stop being mounted to said portion of said valve pin and biased by said resilient member toward said valve case, wherein said valve pin adjuster includes a retainer supporting said resilient member, said retainer being mounted to one axial end of said valve pin that projects from said valve case to inside of said container.

33. An inhalator as claimed in claim 32, wherein said retainer has a limiting portion contacted with said stop to limit an opposite axial movement of said stop when said valve pin is held in said second position.

34. An inhalator as claimed in claim 32, wherein said valve pin adjuster holds said valve pin in said first position when the pressure within said container is less than a predetermined value and in said second position when the pressure within said container is not less than said predetermined value.

35. An inhalator as claimed in claim 32, wherein said stop defines a communicating passage fluidly connecting said upstream portion of said fluid path with inside of said container.

36. An inhalator as claimed in claim 25, wherein said stop has a flange that supports said resilient member and is contacted with said valve case.

37. An inhalator as claimed in claim 26, wherein said communicating passage is formed on the flange of said stop.

38. An inhalator as claimed in claim 32, wherein said bypass passage is arranged at a predetermined portion of said valve pin which is exposed to said upstream portion of said fluid path when said valve pin is held in said first position and which is substantially opposed to said seal when said valve pin is held in said second position.

39. An inhalator as claimed in claim 32, wherein said valve pin has a third position where the fluid communication between said main passage and said upstream portion of said fluid path is established to permit said pressurized fluid to be discharged from said container.

40. An inhalator as claimed in claim 39, wherein said main passage has an inlet open to a predetermined portion on an outer periphery of said valve pin which is axially spaced at a predetermined distance from an axial end of said valve pin that is disposed outside of said container.

41. An inhalator as claimed in claim 32, wherein said pressurized fluid includes a fluid to be aerosolized and a propellant.

42. An inhalator as claimed in claim 41, wherein said propellant includes a liquefied or compressed carbon dioxide gas.

43. An inhalator, comprising:

a container having an open end;

a pressurized fluid stored in said container;

a valve case secured to the open end of said container;

a valve pin moveable relative to said valve case, said valve pin cooperating with said valve case to define a fluid path through which said pressurized fluid is discharged from said container;

a seal arranged within said valve case so as to separate said fluid path into an upstream portion communicating with inside of said container and a downstream portion communicating with outside of said container; and said valve pin defining a main passage always communicating with outside of said container and a bypass passage, said valve pin having a first position where fluid communication between said main passage and said upstream portion of said fluid path is blocked to prevent said pressurized fluid from being discharged from said container and a second position where fluid communication between said upstream portion and said downstream portion of said fluid path is established through said bypass passage to permit said pressurized fluid to flow from said container;

a valve pin adjuster shifting said valve pin between said first position and said second position in response to change in pressure within said container, said valve pin adjuster being mounted to said valve pin, wherein said bypass passage includes a groove open to an outer periphery of said valve pin.

44. An inhalator as claimed in claim 43, wherein said bypass passage includes a through hole having openings spaced from each other in the axial direction of said valve pin.

45. An inhalator as claimed in claim 43, wherein said valve pin adjuster holds said valve pin in said first position when the pressure within said container is less than a predetermined value and in said second position when the pressure within said container is not less than said predetermined value.

46. An inhalator as claimed in claim 43, wherein said valve pin adjuster includes a resilient member acting between said valve case and one axial end of said valve pin that is disposed within said container.

47. An inhalator as claimed in claim 46, wherein said valve pin adjuster includes a stop moveable relative to said valve pin in the axial direction of said valve pin, said stop being mounted to said portion of said valve pin and biased by said resilient member toward said valve case.

48. An inhalator as claimed in claim 47, wherein said stop defines a communication passage fluidly connecting said upstream portion of said fluid path with inside of said container.

49. An inhalator as claimed in claim 48, wherein said stop has a flange that supports said resilient member and is contacted with said valve case.

50. An inhalator as claimed in claim 49, wherein said communicating passage is formed on the flange of said stop.

51. An inhalator as claimed in claim 43, wherein said valve pin has a third position where the fluid communication between said main passage and said upstream portion of said fluid path is established to permit said pressurized fluid to be discharged from said container.

52. An inhalator as claimed in claim 51, wherein said main passage has an inlet open to a predetermined portion on an outer periphery of said valve pin which is axially spaced at a predetermined distance from an axial end of said valve pin that is disposed outside of said container.

53. An inhalator as claimed in claim 43, wherein said pressurized fluid includes a fluid to be aerosolized and a propellant.

54. An inhalator as claimed in claim 53, wherein said propellant includes a liquefied or compressed carbon dioxide gas.

* * * * *